US006505592B1

(12) United States Patent
Hayman et al.

(10) Patent No.: US 6,505,592 B1
(45) Date of Patent: Jan. 14, 2003

(54) VALVE TRAIN FOR TWIN CAM THREE-VALVE ENGINE

(75) Inventors: Alan William Hayman, Romeo, MI (US); James Joseph Mazzola, III, Dryden, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/949,514

(22) Filed: Sep. 7, 2001

(51) Int. Cl.[7] ..... F01L 1/14

(52) U.S. Cl. ..... 123/90.61; 123/90.27; 123/90.41; 123/90.52; 123/90.55

(58) Field of Search ..... 123/90.16, 90.17, 123/90.27, 90.39, 90.4, 90.41, 90.43, 90.44, 90.45, 90.46, 90.48, 90.52, 90.55, 90.61, 308, 315, 432

(56) References Cited

U.S. PATENT DOCUMENTS 6,178,936 B1 * 1/2001 Kouchi et al. ..... 123/193.3

FOREIGN PATENT DOCUMENTS

JP 61155607 * 7/1986 ..... 123/90.27
JP 62048906 * 3/1987 ..... 123/90.27

* cited by examiner

*Primary Examiner*—Thomas Denion
*Assistant Examiner*—Jaime Corrigan
(74) *Attorney, Agent, or Firm*—Leslie C. Hodges

(57) ABSTRACT

A valve train for a twin cam engine has three valves per cylinder, including a pair of side-by-side intake valves and a single exhaust valve on an opposite, exhaust side of the combustion chamber. Dual camshafts in a V-type engine separately drive the intake and exhaust cams through a single dual arm intake rocker arm and a single exhaust rocker arm per cylinder, which provides much improved inlet port airflow for improved specific output compared to a single inlet valve engine. The single exhaust valve provides better catalytic converter performance due to lower exhaust heat loss than in four-valve engines of the same output capability. The intake and exhaust valve trains provide coplanar action of the push rods, rocker arms and valve stem axes, yielding an efficient and simplified valve train with a high flow combustion chamber. Additional features and advantages are disclosed.

9 Claims, 2 Drawing Sheets

VALVE TRAIN FOR TWIN CAM THREE-VALVE ENGINE

TECHNICAL FIELD

This invention relates to engine combustion chamber and valve train arrangements and, more particularly, to a valve train arrangement for a twin cam three-valve engine.

BACKGROUND OF THE INVENTION

It is known in the engine art to provide engine combustion chambers with one or more intake valves and one or more exhaust valves, each arrangement having various advantages and disadvantages. Dual valve arrangements are generally provided for engines where simplicity or economy of manufacture is preferred. Three or four valve arrangements are often provided where the intention is to provide higher horse power output for the same size engine cylinder displacement. Four valve engines are commonly provided with dual overhead camshafts.

U.S. Pat. No. 5,560,329 issued Oct. 1, 1996 to the assignee of the present invention provides a two-valve combustion chamber arrangement in a V-type engine having dual in-block camshafts, one of which actuates the intake valves of the engine and the other of which actuates the exhaust valves. Both camshafts are driven by the engine crankshaft. A cam phasing device is provided for varying the phase angle of one of the camshafts with respect to the other camshaft and the crankshaft. This arrangement allows variable valve timing of the intake or exhaust valves in order to provide improved engine performance at varying speeds and loads. A push rod actuated valve train allows cam phasing with a single cam phaser acting on one of the camshafts as opposed to multiple cam phasers required for accomplishing the same purpose in a dual overhead camshaft engine with multiple cylinder banks.

SUMMARY OF THE INVENTION

The present invention provides a valve train somewhat similar to that disclosed in the previously-mentioned patent combined with a three-valve combustion chamber arrangement. The combustion chamber has a pair of side-by-side intake valves on an intake side of a cylinder and a single exhaust valve on an opposite exhaust side of the combustion chamber or cylinder. The dual camshaft arrangement in a V-type or multi-bank engine provides the same advantages that the arrangement does in the above-noted patent. However, the use of dual intake valves with a single exhaust valve provides much improved intake port airflow for improved specific output compared to a single intake valve engine, while the retention of a single exhaust valve provides better catalytic converter performance due to lower exhaust heat loss than in four-valve engines of the same output capability. Use of a single exhaust valve also provides for better placement of a direct cylinder injector with improved injector targeting over other overhead valve and four-valve engine designs for improved emissions and fuel economy.

The simplified valve train still provides the capability of hydraulic lash adjustment for each valve in the layout and the two camshaft drive provides the advantages of cam phasing for one or both camshafts with one or two cam phasers, respectively. The single exhaust valve may be conventionally actuated by a pushrod to one side of the cylinder, allowing a coplanar arrangement of the exhaust valve and pushrod with a rocker arm acting in the same plane and the valve head placed flush with the combustion chamber surface surrounding the valve seat.

These and other features and advantages of the invention will be more fully understood from the following description of certain specific embodiments of the invention taken together with the accompanying drawings.

DESCRIPTION OF THE PREFERRED EMBODIMENT

Figure 1:
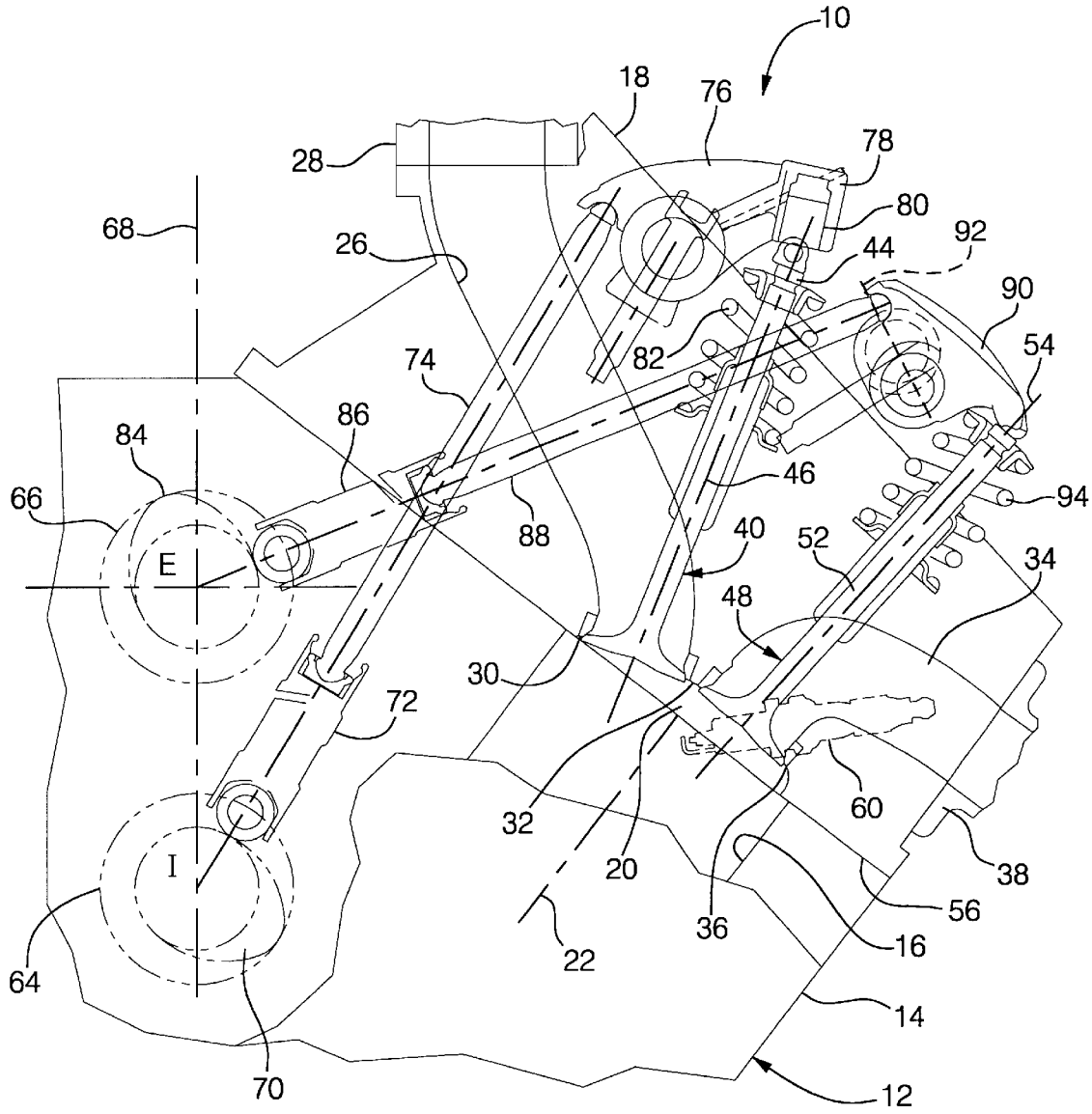
FIG. 1 is a fragmentary cross-sectional view showing a portion of a V-type engine having a valve train in accordance with the invention.

Referring first to FIG. 1 of the drawings in detail, numeral 10 generally indicates a V-type internal combustion engine having a cylinder block 12 defining a pair of cylinder banks 14, only one of which is shown. Each cylinder bank 14 normally includes a plurality of longitudinally-spaced cylinders 16, each cylinder carrying a reciprocating piston connected with a crankshaft, neither of which is shown.

Figure 2:
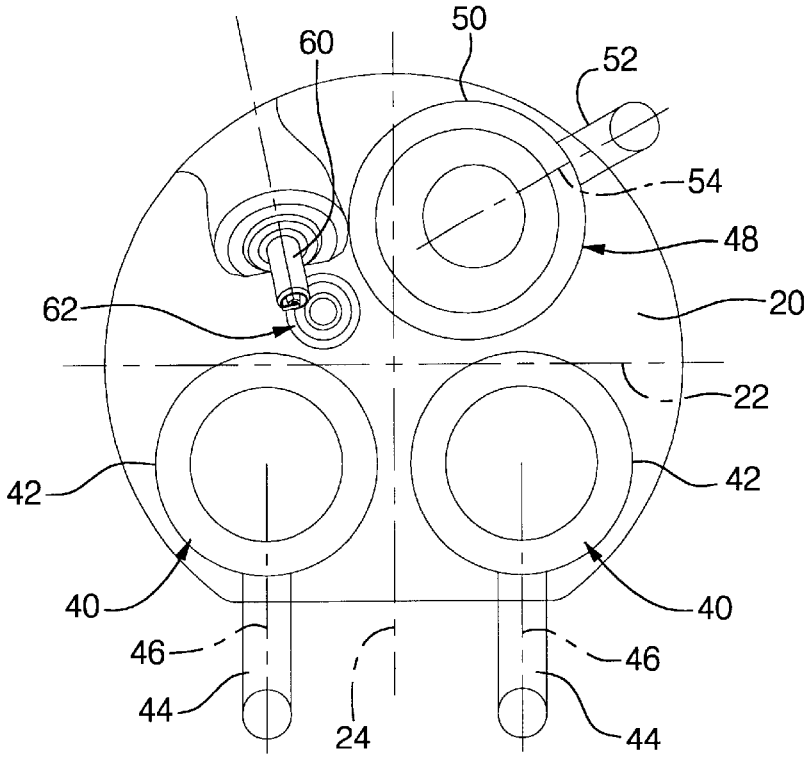
FIG. 2 is a lower plan view of the combustion chamber of one cylinder of the engine viewed from the lower face of the cylinder head.

Each cylinder bank carries a cylinder head 18 defining a combustion chamber 20 closing the ends of the cylinders 16. A lower view of the single illustrated combustion chamber 20 is shown in FIG. 2. Each cylinder bank defines a longitudinal plane 22 which passes through the aligned central axes of the cylinders of that bank. Each cylinder also defines a lateral plane 24 intersecting the longitudinal plane at the central axis of each of the cylinders.

Each cylinder head defines a pair of longitudinally-spaced intake ports 26 for each cylinder, the ports connecting an associated intake manifold 28 with valve seats 30 formed adjacent the inner surface 32 of the combustion chamber 20. The cylinder heads further define single exhaust ports 34 for each cylinder connecting exhaust valve seats 36 with externally mounted exhaust manifolds 38.

The intake ports 26 are controlled by dual intake valves 40 having heads 42 seatable on the valve seats 30 and preferably longitudinally spaced equally on opposite sides of the lateral planes 26 of their respective cylinder. Valve stems 44, connected with the heads 42, preferably extend along parallel valve axes 46, canted with respect to the cylinder axis 24 but extending parallel to the lateral plane 26 of the cylinder.

Similarly, each cylinder has a single exhaust valve 48 controlling its respective exhaust port 34 and including an exhaust valve head 50 seatable on its valve seat 36 and a valve stem 52 extending on a canted axis 54. The axis 54 forms a compound angle relative to the lower cylinder head surface 56 and thus lies in a plane which is not parallel with either of the longitudinal and transverse planes through its respective cylinder. This is caused by the placement of the exhaust valve 48 on the outboard side of the cylinder and longitudinally offset to one side of the lateral plane 24, while the inner surface of the exhaust valve head 50 is located generally flush with the adjacent surface of the combustion chamber.

With this placement of the exhaust valve, the space longitudinally opposite the exhaust valve may be used for mounting a spark plug 60 and, if desired, a direct injection fuel injector 62. Optional alternative arrangements for the exhaust valve and spark plugs will be subsequently discussed.

Referring again to FIG. 1, the intake and exhaust valves 40, 48 of the engine are actuated by a valve train which includes separate intake and exhaust camshafts 64, 66, respectively. The camshafts are rotatably carried within the engine block 12 and extend longitudinally therein. Both camshafts are driven by chain or other conventional drive means from the engine crankshaft, not shown. As illustrated, the exhaust camshaft 66 is located above the intake camshaft 64, both being aligned on a central plane 68 of the engine block 12. The camshafts are mounted within the "V" or valley of the engine between the cylinder banks 12.

The intake camshaft 64 includes intake cams 70 which actuate reciprocable followers 72. The followers drive pushrods 74, each connecting with a single rocker arm 76 having dual output arms 78, each carrying a hydraulic lash adjuster 80. If desired, mechanical lash adjusters could be provided instead of the hydraulic type. The lash adjusters 80 are positioned to engage the ends of the intake valve stems 44 so as to open the valves when the rocker arm is actuated by the cam follower 72 and pushrod 74 of the respective cylinder. Preferably, the single pushrod 74 is aligned with the cam follower on the lateral plane 24 of the cylinder and the dual arms 76 and lash adjusters 80 are aligned with the valve stems 44 in planes passing through the respective valve axes 46. Conventional valve springs 82 are provided to return the valves to their seated positions when the cam follower travels down the backside of the cam 70.

Similarly, the exhaust camshaft 66 is provided with exhaust cams 84 which actuate exhaust cam followers 86. Followers 86 actuate pushrods 88 which in turn pivot exhaust rocker arms 90 on canted axes 92. The rocker arms 90 directly engage the stems 52 of the respective exhaust valves 48 to open the valves upon actuation by the respective exhaust cams 70. Valve springs 94 again provide for closing of the exhaust valves when the followers 72 move down the closing side of the exhaust cams 70. To adjust lash in the valve trains of the single exhaust valve for each cylinder, the exhaust cam followers 86 are provided with internal hydraulic lash adjusters, not shown, which operate in known manner. If desired, lash adjusters could instead be mounted on the rocker arms and mechanical adjusters could be provided, if desired.

In operation of the engine, the timings of the intake and the exhaust valves are controlled separately by the individual intake and exhaust camshafts. Accordingly, either or both of the camshafts may be provided with cam phaser devices which are operable to vary the phase rotation of the respective camshaft relative to the crankshaft. In this way, the intake cams may be varied as to their opening and closing timing relative to the exhaust cams and vice versa.

The particular three-valve arrangement of the cylinder, shown in FIGS. 1 and 2, provides a number of specific advantages. For one, asymmetrical rocker arms are not required. Further, the splayed exhaust valve arrangement with compound valve angles on the exhaust side allows for a larger exhaust valve for a given bore size than is possible with dual exhaust valves. Packaging of the splayed valve allows for an improved spark plug location in the space longitudinally opposite the valve on the outside (exhaust side) of the cylinder. The arrangement also allows a vertical or near vertical fuel injector orientation for direct injection fuel systems. Additionally, the water jacket geometry surrounding the exhaust valve provides for more optimum coolant flow around the valve seat.

In the case of a cam phased three-valve engine, the disclosed overhead valve configuration with a single exhaust valve allows for a valve event of much longer duration than a non-phased configuration. This longer event permits operation with lower valve lift for a given level of exhaust port performance, which reduces valve train stress and allows for an increase of valve train operating speed which may increase specific power output. Additionally, the three-valve arrangement greatly simplifies the valve train for the engine and the offset exhaust valve permits arrangement of the exhaust pushrod and valve stem axes in a common plane in which the rocker arm 90 pivots on an axis normal to the plane of the exhaust valve and pushrod. Note, however, that the exhaust cam follower 86 has an axis that lies normal to the exhaust camshaft 66. Accordingly, the roller follower 86 is rotated relative to the exhaust valve plane to rotate on an axis parallel to that of the exhaust camshaft. Thus, a co-planar arrangement of the exhaust valve axis 54, exhaust pushrod 88, and the exhaust rocker arm 90 is maintained without requiring canting of the exhaust cam follower relative to the camshaft. To accomplish this, the cam follower 86 is located to one side of the cylinder and the pushrod 88 extends longitudinally outboard of the pushrods of the dual intake valves.

Figure 3:
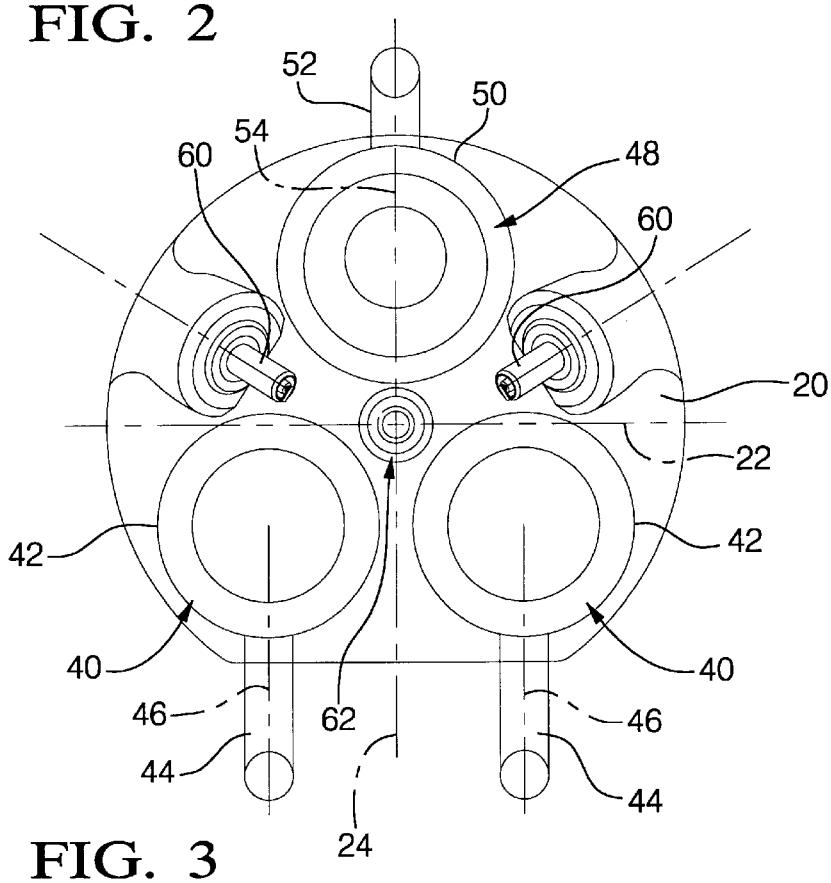
FIG. 3 is a view similar to FIG. 2 but showing an alternative embodiment in which the exhaust valve train is coplanar with the lateral centerline or lateral plane of the cylinder.

Referring now to FIG. 3, there is shown one of numerous possible alternative arrangements for a three-valve engine having a valve train in accordance with the invention. In FIG. 3, wherein like numerals indicate like parts, the position of the intake valves 40 is maintained but the location of the exhaust valve 48 is changed so that the valve is centered on the transverse plane 24 of the cylinder with the valve axis 54 lying in the plane 24. While such an arrangement is practical, it may require some modification of the valve train itself. For example, separate cam followers for the intake valves could be used so that a centered exhaust cam follower 86, push rod 88, rocker arm 90, and the exhaust valve axis 54 all lie in the lateral plane 24 through the axis of the cylinder. Other arrangements for actuating the valves could also be provided. With such an arrangement, it would be possible to provide dual spark plugs, one on either side of the exhaust valve as shown. However, a more conventional side entry point for a direct fuel injector might have to be resorted to. Nevertheless, the advantages of the larger exhaust valve and the generally flush position of the valve head in the cylinder are advantages which would remain in the modified three-valve arrangement with their accompanying benefits. Of course, it would alternatively be possible to operate the engine with a single spark plug if desired, depending upon the arrangement of the combustion chamber on the piston side of the cylinder.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An internal combustion engine including a cylinder bank defining a longitudinal plane including a cylinder having an axis in said plane and a variable volume combustion chamber at a closed end of the cylinder, inlet and exhaust overhead valves operable to regulate fluid flow through said closed end of the cylinder, a first exhaust camshaft and a second intake camshaft extending in longitudinal parallel relation on one side of said longitudinal plane on an intake side of the cylinder, wherein said engine comprises:

dual intake valves aligned longitudinally on the intake side of the cylinder and operatively connected with the intake camshaft for simultaneous actuation of the intake valves on parallel axes; and a single exhaust valve on an exhaust side of the cylinder laterally opposite from the intake side, the exhaust valve operatively connected with the exhaust camshaft for separate actuation of the exhaust valve on a canted axis.

2. An engine as in claim 1 wherein the exhaust valve includes a head seatable on the cylinder closed end and is actuated on an axis canted with respect to the cylinder axis such that the valve head when seated is generally flush with the surface of the combustion chamber surrounding the valve head.

3. An engine as in claim 2 wherein the exhaust valve is offset in the combustion chamber to one side of a lateral cylinder plane through the cylinder axis, and the exhaust valve axis is canted at a compound angle relative to the cylinder axis.

4. An engine as in claim 1 wherein the dual intake valves are opened by an intake rocker arm actuated by a single intake pushrod from a single cam of the intake camshaft.

5. An engine as in claim 4 wherein the intake rocker arm is pivotable on an axis parallel with the intake camshaft and the intake pushrod lies in a plane normal to the intake camshaft.

6. An engine as in claim 4 wherein the intake valves are longitudinally equally spaced on opposite sides of a lateral cylinder plane through the cylinder axis and including the intake pushrod.

7. An engine as in claim 4 wherein the intake rocker arm carries dual lash adjusters for separately adjusting the lash of the dual intake valves.

8. An engine as in claim 1 wherein the exhaust valve is opened by an exhaust rocker arm actuated by an exhaust pushrod, the exhaust rocker arm being pivotable in a second plane formed by the exhaust pushrod and the exhaust valve axis, the exhaust pushrod being generally normal to the axis of the exhaust camshaft.

9. An engine as in claim 8 including a cam follower connected between the pushrod and an exhaust cam on the exhaust camshaft, and a lash adjuster in the cam follower for adjusting the lash of the exhaust valve.

* * * * *